US010746177B2

(12) United States Patent
Collins

(10) Patent No.: US 10,746,177 B2
(45) Date of Patent: Aug. 18, 2020

(54) COMPRESSOR WITH A CLOSED LOOP WATER COOLING SYSTEM

(71) Applicant: Ingersoll-Rand Company, Davidson, NC (US)

(72) Inventor: James Christopher Collins, Mooresville, NC (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 425 days.

(21) Appl. No.: 14/959,673

(22) Filed: Dec. 4, 2015

(65) Prior Publication Data

US 2016/0186757 A1 Jun. 30, 2016

Related U.S. Application Data

(60) Provisional application No. 62/098,479, filed on Dec. 31, 2014.

(51) Int. Cl.

| | |
|---|---|
| ***F25B 5/02*** | (2006.01) |
| ***F04C 29/04*** | (2006.01) |
| ***F04D 29/063*** | (2006.01) |
| ***F04C 29/02*** | (2006.01) |
| ***F04B 25/04*** | (2006.01) |

(Continued)

(52) U.S. Cl.

CPC ..... *F04C 29/04* (2013.01); *F04B 25/04* (2013.01); *F04B 39/02* (2013.01); *F04B 39/0207* (2013.01); *F04B 39/06* (2013.01); *F04B 41/02* (2013.01); *F04C 18/16* (2013.01); *F04C 29/02* (2013.01); *F04C 29/021* (2013.01); *F04D 29/063* (2013.01); *F04D 29/701* (2013.01); *F04D 31/00* (2013.01); *F25B 5/02* (2013.01); *F25B 25/005* (2013.01); *F04C 2210/221* (2013.01); *F04C 2270/195* (2013.01)

(58) Field of Classification Search

CPC ..... F04D 29/06; F04D 29/58; F04C 15/0088; F04C 29/0204; F04C 29/04; F04C 29/045; F04C 23/00; F04B 39/06; F04B 39/0207; F04B 39/02; F04B 39/023; F25B 31/002; F25B 31/004

USPC ..... 62/84, 468

See application file for complete search history.

(56) References Cited

U.S. PATENT DOCUMENTS 3,876,401 A * 4/1975 Sturgill ..... B01D 46/00 55/481

4,362,131 A * 12/1982 Mason ..... F01P 3/20 123/41.1

(Continued)

FOREIGN PATENT DOCUMENTS

CN 202973648 U 6/2013

*Primary Examiner* — Filip Zec

(74) *Attorney, Agent, or Firm* — Taft Stettinius & Hollister LLP

(57) ABSTRACT

The present disclosure provides a compressor system having at least one fluid compressor for compressing a working fluid. A lubrication supply system is operable for supplying lubrication fluid to the compressor. A closed loop cooling system using R718 refrigerant is provided to cool the working fluid. The closed loop cooling system includes a refrigerant compressor for compressing the refrigerant, a condenser operable for receiving compressed refrigerant gas and removing heat to form liquid refrigerant, and an expansion device for expanding and cooling the liquid refrigerant into a cooled gaseous refrigerant.

7 Claims, 3 Drawing Sheets

(51) Int. Cl.

| | |
|---|---|
| ***F04B 39/02*** | (2006.01) |
| ***F04B 39/06*** | (2006.01) |
| ***F04B 41/02*** | (2006.01) |
| ***F04D 29/70*** | (2006.01) |
| ***F25B 25/00*** | (2006.01) |
| ***F04D 31/00*** | (2006.01) |
| ***F04C 18/16*** | (2006.01) |

(56) References Cited

U.S. PATENT DOCUMENTS 5,056,601 A 10/1991 Grimmer
5,462,110 A 10/1995 Sarver
5,653,585 A * 8/1997 Fresco ..... F04C 18/16 418/100
5,720,599 A 2/1998 Myers
5,947,711 A 9/1999 Myers et al.
6,022,200 A 2/2000 Myers
7,172,015 B2 2/2007 Miura et al.
7,536,998 B2 * 5/2009 Held ..... F01P 7/165 123/542
8,122,738 B2 * 2/2012 Saul ..... A23L 3/3418 62/274
8,695,358 B2 * 4/2014 Kaufmann ..... H01H 9/52 62/62
2003/0079728 A1 * 5/2003 Marsh ..... F01P 3/20 123/563
2005/0103016 A1 * 5/2005 Radcliff ..... F01K 23/065 60/670
2006/0042311 A1 * 3/2006 Esslinger ..... F25B 40/02 62/513
2008/0087402 A1 * 4/2008 Burk ..... F02B 29/0443 165/101
2011/0139131 A1 * 6/2011 Kardos ..... F01P 3/12 123/542
2013/0089413 A1 4/2013 Fujimoto et al.
2014/0102103 A1 * 4/2014 Yamamoto ..... F01K 15/00 60/658
2014/0260404 A1 * 9/2014 Verma ..... F25B 9/008 62/333
2014/0345280 A1 * 11/2014 Son ..... F01K 23/065 60/670
2015/0285264 A1 * 10/2015 Kennedy ..... B61C 5/02 417/53
2016/0109156 A1 * 4/2016 Yin ..... B21C 37/151 122/15.1
2016/0169079 A1 * 6/2016 Zhou ..... F01P 3/2271 60/670

* cited by examiner

COMPRESSOR WITH A CLOSED LOOP WATER COOLING SYSTEM

CROSS REFERENCE TO RELATED APPLICATIONS

This application claims the benefit of U.S. Provisional Application No. 62/098,479, filed Dec. 31, 2014, which is incorporated herein by reference in its entirety.

TECHNICAL FIELD

The present application generally relates to industrial air compressor systems and more particularly, but not exclusively, to a compressor system having a closed loop water cooling system.

BACKGROUND

Industrial compressor systems are configured to produce large volumes of pressurized fluid such as air or the like. These compressor systems typically include cooling systems to cool fluids such as high temperature compressed air and oil or the like. Some compressor systems are located in regions of the world where water supply is scarce. These regions can also have relatively high ambient temperatures which causes difficulties in providing adequate cooling to system fluids. Some existing systems have various shortcomings relative to certain applications. Accordingly, there remains a need for further contributions in this area of technology.

SUMMARY

One embodiment of the present invention is a unique compressor system with a closed loop water cooling system. Other embodiments include apparatuses, systems, devices, hardware, methods, and combinations for compressor systems with a unique method of cooling fluids in a compressor system with a closed loop cooling system using R718 (water) as a refrigerant. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
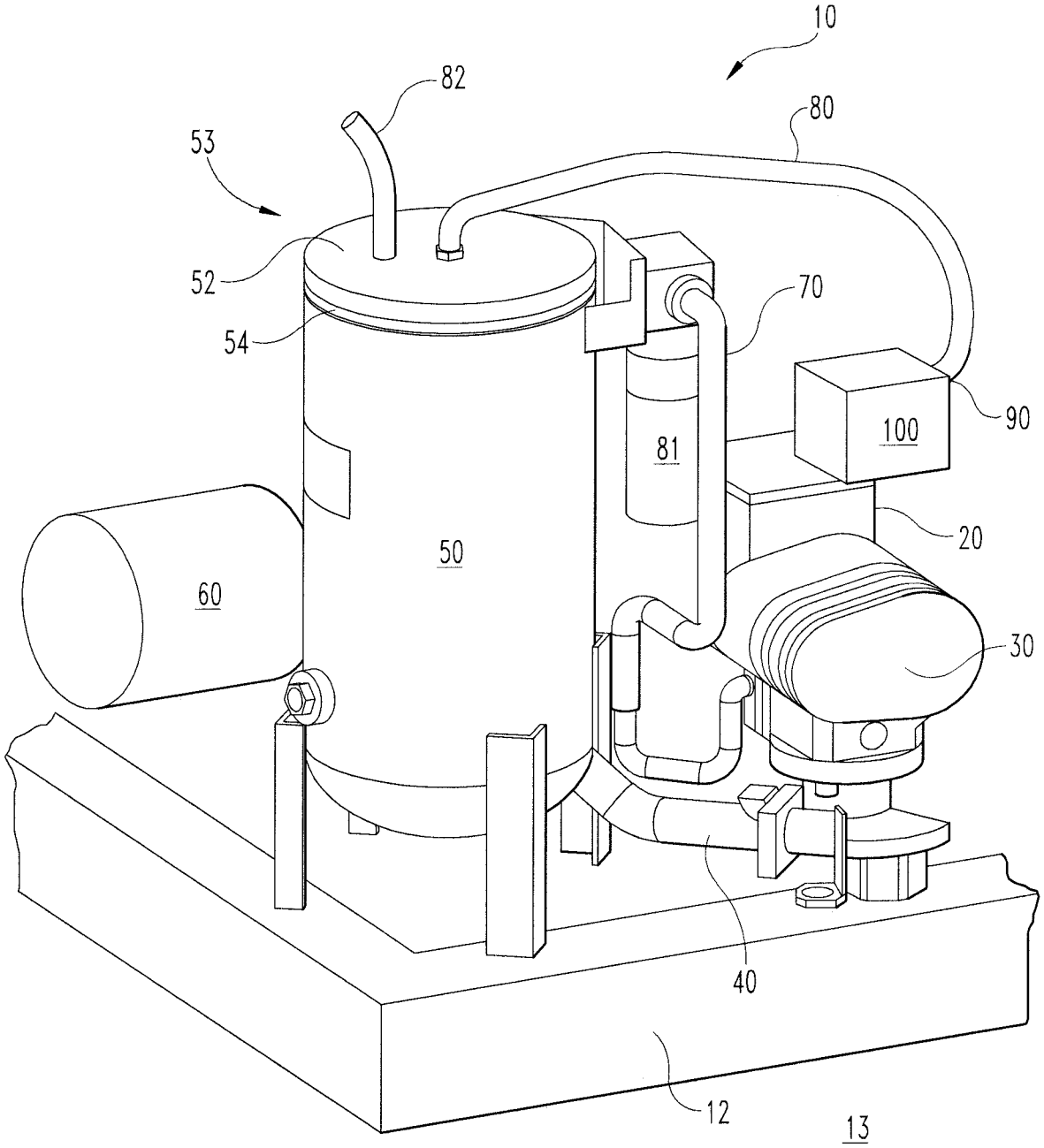
FIG. 1 is a perspective view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Industrial compressor systems are configured to provide large quantities of compressed fluids at a desired temperature, pressure and mass flow rate. Some compressor systems use fluid to fluid heat exchangers to control the temperature of compressed fluids at various stages within the system. The term "fluid" should be understood to include any gas or liquid medium used in the compressor system as disclosed herein. In one form the compressed working fluid is disposed in fluid communication with a user's compressed working fluid network. In some forms the present application can be directed to delivery of pressurized fluid with more than one fluid constituency such as a mixture of air and lubrication fluids including oil or the like. In other forms, the present application can be directed to the delivery of pressurized oil free working fluid from an oil free compression chamber environment. More specifically, the compression chamber which houses the rotatable rotors is free of oil and oil related materials whether considered a petrochemical based oil or a synthetic based oil. The term oil as utilized herein is intended to refer generally to a class of lubricants that are either petroleum or synthetic based and have a variety of viscosities; non limiting examples include grease or oil.

A closed loop cooling system using water (R718) as a refrigerant can be used to cool portions of a compressor system including various working fluids therein. In one form of the present application the R718 refrigerant is clean or pure water so as to be substantially free of contaminants and minerals. In other forms the water can be potable water that is not free of all additives, including natural or man-made chemicals. In some forms the additives may be toxic or non-toxic. In yet other forms the water may not be potable, but still retain properties that permit phase change between gas and liquid in a refrigeration cycle. The present disclosure provides an apparatus and method for cooling fluids in an industrial compressor system using R718 refrigerant. The closed loop water cooling system defined herein can maximize cooling efficiency in regions of the world having water scarcity and high ambient temperatures, however the system can be used advantageously anywhere in the world.

Referring now to FIG. 1, an exemplary compressor system 10 is shown in perspective view. The compressor system 10 includes a primary motive source 20 such as an electric motor, an internal combustion engine or a fluid-driven turbine and the like. The compressor system 10 can include a compressor 30 that may include multi-stage compression. The compressor 30 can include a screw, centrifugal, axial and/or positive displacement compression means. The primary motive source 20 is operable for driving the compressor 30 via a drive shaft (not shown) to compress gaseous fluids such as air and oil vapor or the like.

A structural base 12 is configured to support at least portions of the compressor system 10 on a support surface 13 such as a floor or ground. Portions of the compressed working fluid discharged from the compressor 30 can be transported through one or more conduits 40 to a sump or separator tank 50 for separating fluid constituents such as air and oil or the like. One or more coolers 60 can be operably coupled with the system 10 for cooling working fluids to a desired temperature. The one or more coolers 60 can cool fluids such as compressed air or oil to a desired temperature. The compressor system 10 can also include a controller 100 operable for controlling the primary motive power source 20 and various valving and fluid control mechanisms (not shown) between the compressor 30 and intercoolers 60 such as a blowdown valve 90.

The separator tank 50 can include a lid 52 positioned proximate a top portion 53 thereof. A seal 54 can be positioned between the lid 52 and separator tank 50 so as to provide a fluid tight connection between the lid 52 and the separator tank 50. Various mechanical means such as threaded fasteners (not shown) or the like can be utilized to secure the lid 52 to the separator tank 50. A blow down conduit 80 can extend from the separator tank 50 to the blow down valve 90. The blow down valve 90 is operable for reducing pressure in the separator tank 50 when the compressor 30 is unloaded and not supplying compressed air to an end load. A compressed air supply conduit 82 can be operably coupled to the separator tank so as to deliver compressed air to a separate holding tank (not shown) or to an end load for industrial uses as would be known to those skilled in the art. An oil supply conduit 70 can extend from the separator tank 50 to the compressor 30 to supply oil that has been separated from the working fluid in the separator tank 50 to the compressor 30. One or more filters 81 can be used in certain embodiments to filter particles from the oil and/or separate contaminates such as water or the like from working fluids in the compressor system 10.

Figure 2:
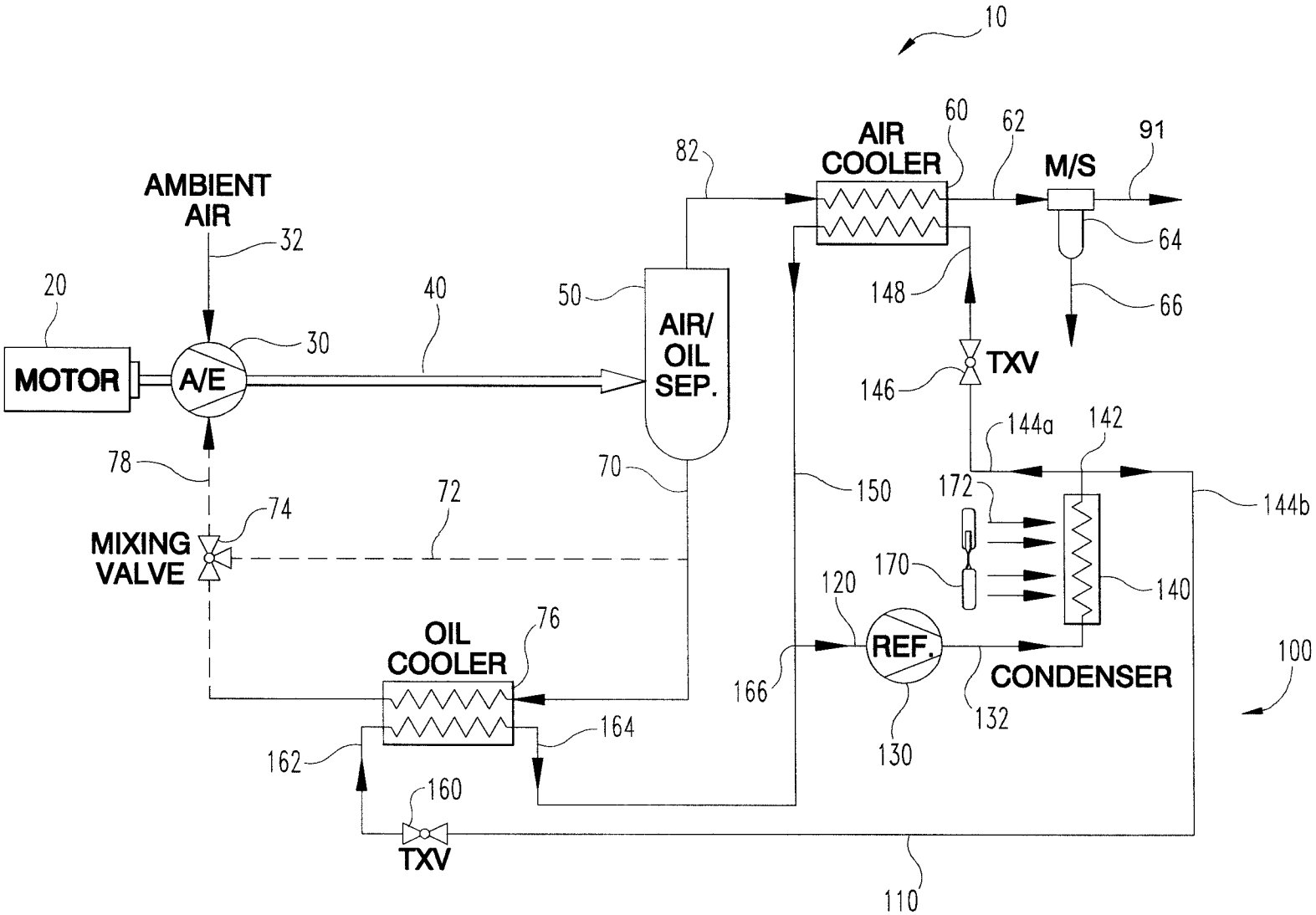
FIG. 2 is a schematic view of a portion of the compressor system of FIG. 1 illustrating a closed loop cooling system according to one embodiment of the present disclosure.

Referring now to FIG. 2, the compressor system 10 is illustrated in schematic form. A motive power source 20 such as an electric motor is operable to drive an air end compressor 30 to a desired rotational speed. The compressor 30 receives ambient air through an air inlet 32 and discharges relatively high pressure and high temperature compressed air to a compressed fluid discharge or outlet conduit 40. In this exemplary embodiment, the compressor system can include a lubricated compressor such as a screw compressor or the like wherein the discharge conduit 40 includes a high pressure fluid comprising compressed air and oil as is known to those skilled in the art. It should be understood that the compressor system of the present application can utilize any type of compressor system such as centrifugal, positive displacement gear type, piston type, axial flow or others including oil free compression as would be known to the skilled artisan. In this non-limiting example, the compressed fluid is supplied to an air/oil separator tank 50 through the discharge conduit 40 such that compressed air and oil can be separated. The compressed air can be discharged from the separator tank 50 through a compressed air supply conduit 82. The oil can be transported from the separator tank 50 through an oil supply conduit 70 connected thereto. The oil supply conduit 70 can be routed to an oil bypass conduit 72 or optionally through an oil cooler 76. A mixing valve 74 is operable for mixing a portion of the oil that flows through the oil bypass conduit 72 and a portion of oil that flows through the optional oil cooler 76. In some forms, all of the oil egressing from the separator tank 50 will be transferred through the oil cooler 76 prior to flowing through the oil inlet 78 operably coupled to the air end compressor 30.

The compressed air supply conduit 82 can be routed to an air cooler or heat exchange unit 60 for cooling the hot compressed air to a desired temperature. It should be understood that while only one air cooler and one oil cooler are illustrated in this exemplary embodiment, that multiple air coolers and/or multiple oil coolers may be implemented and are contemplated by the present disclosure. The compressed air can exit the air cooler 60 through an air cooler outlet 62 and can be routed through an optional moisture separator 64 so as to separate water or other liquid constituents from the compressed air through a water drain 66 whereby relatively pure compressed air without contaminating liquids can egress through an outlet conduit 91 to an end load requiring compressed air.

Turning now to the closed loop cooling circuit 100, a hermetically sealed R718 (water) refrigerant pathway 110 is formed so that during system operation water need not be added or removed from the refrigerant pathway 110. An R718 compressor inlet 120 delivers R718 refrigerant to an R718 compressor 130 to compress a relatively low pressure gas into a relatively high pressure, high temperature gas that is transported from the compressor outlet 132 to a condenser 140. The relatively hot gas is converted to a high pressure cooler liquid through heat transfer means in the condenser 140.

A fan 170 can be utilized to force cooling flow illustrated by arrows 172 through the condenser to convert the high pressure hot gas refrigerant to a cooler liquid. The cooling flow 172 can be ambient air in some embodiments. The high pressure cooler R718 liquid is transported out of the condenser 140 into an optional flow splitter 142 wherein the refrigerant pathway 110 can split to a primary condenser outlet path 144A and a secondary condenser outlet path 144B fluidly connected to an oil cooler 76 in some optional configurations. The liquid R718 can be transported along the primary condenser outlet flow path 144A and carried to an air cooler expansion valve 146 wherein the liquid R718 is converted to a relatively lower temperature two-phase fluid prior to entering an air cooler inlet 148. The air cooler inlet 148 transports the cooler two-phase fluid through the air cooler 60 (sometimes called an evaporator) such that heat is exchanged from the relatively hot compressed air transported through the air supply conduit 82 to the relatively cool two-phase R718 fluid. The two-phase R718 fluid will increase in temperature which will cause a phase change to a pure gas form. The R718 gas exits the air cooler 60 through an air cooler outlet 150 and is transported to an optional refrigerant flow tee member 166 wherein the gaseous refrigerant is transferred to the refrigerant compressor inlet 120 to run again through a continuous cycle.

If the optional oil cooler 76 is installed in a particular configuration, the portion of the refrigerant that flows through the oil cooler 76 will be combined at the tee 166 to flow through the refrigerant compressor inlet 120. The flow splitter 142 will transport a portion of the condenser outlet refrigerant through flow path 144B to an optional oil cooler expansion valve 160 so as to convert the high pressure liquid to a relatively low pressure cool two-phase fluid similar to the air cooler side of the closed loop cooling circuit 100. The two-phase R718 fluid is then transported through an oil cooler refrigerant inlet conduit 162 and through the oil cooler 76 so as to transfer heat from the oil to the refrigerant wherein the refrigerant is converted to a higher temperature gas and transported to an oil cooler outlet 164 and to the flow tee 166 wherein the two R718 flow paths are combined prior to entering the refrigerant compressor 130. This cycle will continue uninterrupted while the compressor system 10 is in operation.

Figure 3:
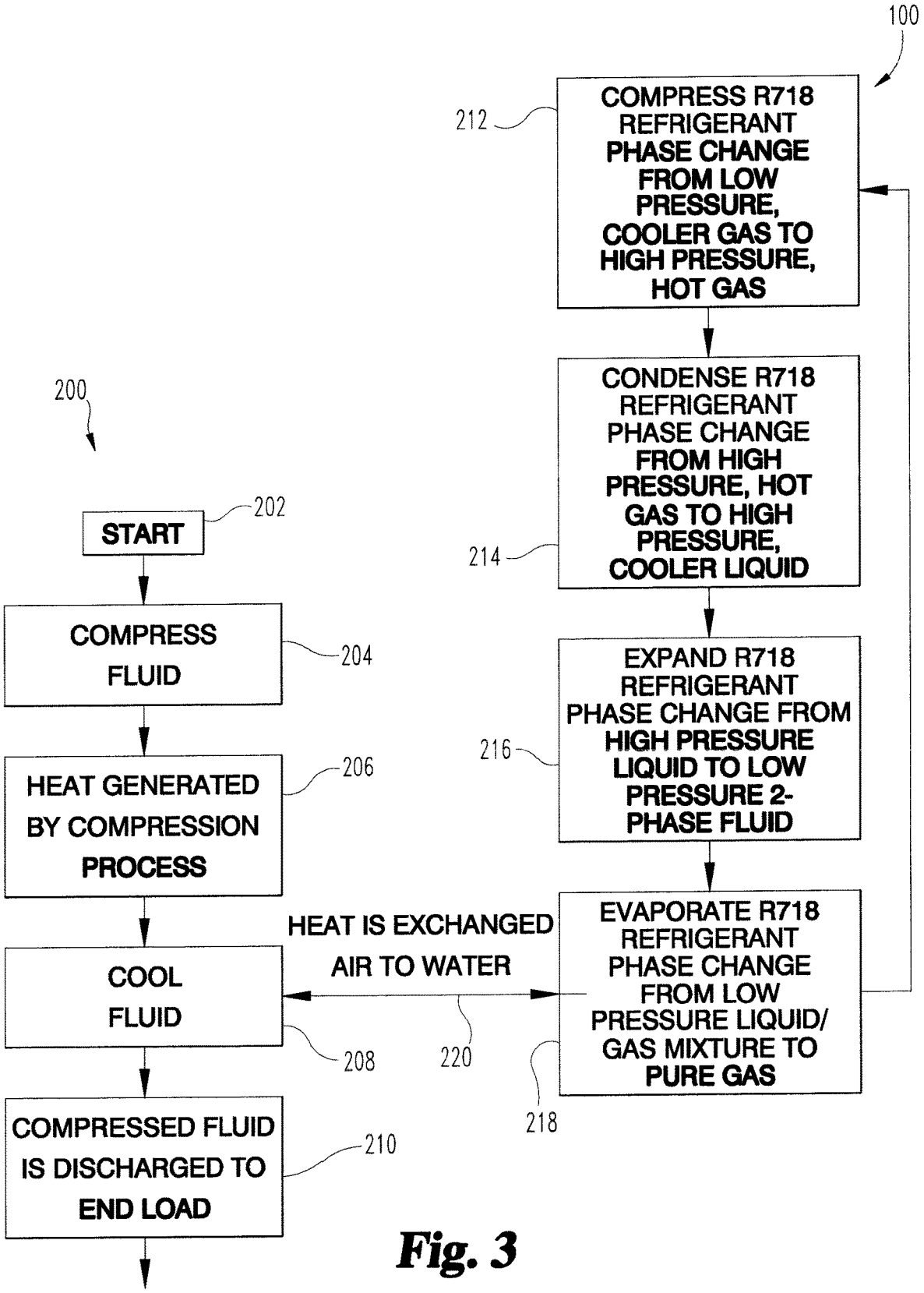
FIG. 3 is system flow chart illustrating operation of the compressor and cooling system of FIG. 2.

Referring now to FIG. 3, a compressor system process flow chart 200 is illustrated therein. The system process starts at step 202 by compressing a fluid, such as air or the like, at step 204. Heat is generated by the compression process and is transferred to the compressed fluid at step 206. At step 208, the high temperature compressed fluid is cooled through a heat exchange process by transferring heat from the compressed fluid to R718 refrigerant. The compressed fluid, after being cooled, is discharged to an end load for use in an industrial setting at step 210. Turning to the closed loop cooling circuit portion 100, the refrigerant compressor changes the phase of the R718 refrigerant from a low pressure cooler gas to a high pressure hot gas at step 212. At step 214, a condenser changes the R718 refrigerant from a high pressure hot gas to a high pressure cooler liquid. At step 216, an R718 expansion device changes the high pressure liquid refrigerant to a low pressure two-phase fluid. At step 218, an R718 evaporator or heat exchanger is operable for exchanging heat from the gaseous working fluid to the R718 refrigerant, wherein a low pressure two-phase R718 fluid changes to a pure gas as heat is transferred from the working fluid to the R718 refrigerant at step 220.

In operation the compressor system is configured to provide compressed air at a desired temperature and pressure to external systems. The compressor systems can be used in any industrial application including, but not limited to automobile manufacturing, textile manufacturing, process industries, refineries, power plants, mining, material handling, etc. The controller permits user input to define parameters such as pressure, temperature and mass flow rate of various working fluids. The controller will send command signals to the motor to rotate at a desired operating speed in order to drive the one or more compressors and control various valving to modulate airflow rate, coolant flow rate and/or lubrication flow rates.

In the illustrative example, the compressor system includes a single-stage screw type compressor system, however, the system can operate with other types of compressors and/or with more or less stages of compressors. One or more intercoolers can be fluidly coupled to each compressor stage such that after air is compressed through a compression stage the air can be transported through an intercooler coupled to a closed loop water cooling system and cooled to a desired temperature via a heat transfer mechanism such as conduction and convection in tube type heat exchangers.

The compressed air can then be transported to additional compressor stages where the air is further compressed and necessarily heated to a higher temperature through a thermodynamic process. The compressed air can then be routed through subsequent intercooler stages coupled to the closed loop water cooling system to cool the air to a desired temperature without substantial loss of pressure. When the air is compressed to a final desired pressure and cooled to a desired temperature, the compressed air is discharged to a final subsystem or end load.

In one aspect, the present disclosure includes a compressor system comprising: at least one fluid compressor for compressing a working fluid; a lubrication supply system operable for supplying lubrication fluid to the compressor; a closed loop cooling system comprising a refrigerant compressor for compressing a refrigerant; a condenser operable for receiving compressed refrigerant gas and removing heat for form a liquid refrigerant; an expansion device for expanding and cooling the liquid refrigerant into a cooled gaseous refrigerant; a heat exchanger in fluid communication with the refrigerant; and wherein the refrigerant is R718 (water).

In refining aspects, the present disclosure system includes a compressor system wherein the closed loop cooling system is defined by a hermetically sealed refrigerant flowpath such that R718 refrigerant is not removed or replaced in the flowpath during system operation; wherein the heat exchanger is in fluid communication with lubrication fluid; wherein the heat exchanger is in fluid communication with the working fluid; a plurality of heat exchanger in fluid communication with refrigerant; at least one bypass conduit for bypassing at least one of the plurality of heat exchangers; at least one control valve to control flow rate of one or more fluids in the system; wherein the working fluid includes air; an electronic controller operably connected to at least one component in the compressor system; at least one separator tank structured to receive compressed working fluid from the compressor and separate air and lubricating fluid from the working fluid; at least one sensor for sensing at least one of a pressure, a temperature and/or a mass flow rate of at least one of the fluids in the system; a fan for generating a cooling fluid flow across the condenser; wherein the cooling fluid includes air; a motive source for powering the compressor; and a moisture separator positioned downstream of the heat exchanger for removing water from the compressed working fluid.

In another aspect, the present disclosure includes an apparatus comprising: an air compressor operable for compressing air; a lubrication supply system operable for supplying lubrication to the compressor; a closed loop cooling system comprising: a hermetically sealed cooling system pathway for transporting R718 refrigerant; a refrigerant compressor for compressing the R718 refrigerant; a condenser operable for ingressing compressed R718 refrigerant gas and egressing liquid R718 refrigerant; an evaporator for expanding and cooling the liquid R718 refrigerant into a cooled gaseous R718 refrigerant; a heat exchanger in fluid communication with the R718 refrigerant and the compressed air; and a control system operable for controlling portions of the cooling system, the lubrication system, and the air compressor.

In refining aspects, the present disclosure includes an apparatus wherein the control system includes at least one pressure sensor, temperature sensor and/or mass flow sensor; wherein the control system includes an electronic controller operable for receiving and transmitting control signals; wherein the air compressor includes more than one compression stage; wherein the air compressor is one of a screw, gear, piston, or centrifugal type; wherein R718 is pure water; and wherein R718 includes contaminants at a level insufficient to prevent phase change of the refrigerant while flowing through the cooling system pathway.

In another aspect, the present disclosure includes a method comprising: compressing a working fluid with a compression device; heating the working fluid during the compressing; cooling the working fluid with a closed loop system; wherein the closed loop cooling system comprises: a hermetically sealed refrigerant flow path; an R718 refrigerant contained within the refrigerant flowpath; compressing the R718 refrigerant to a relative high temperature and high pressure gas; condensing the R718 gas to a liquid form; expanding the R718 to a low pressure two-phase fluid; and transferring heat from the working fluid to the R718 refrigerant.

In refining aspects, the present disclosure includes a method comprising: supplying lubrication fluid to the compression device; and cooling the lubrication fluid with the closed loop cooling system.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. An apparatus comprising:

an air compressor operable for compressing air;

a lubrication supply system operable for supplying lubricant to the compressor;

a closed loop cooling system comprising:

a hermetically sealed cooling system pathway for transporting R718 refrigerant;

a refrigerant compressor for compressing the R718 refrigerant;

a single condenser operable for ingressing compressed R718 refrigerant and egressing cooled R718 refrigerant;

an R718 refrigerant flow splitter positioned downstream of the single condenser and having an inlet for receipt of a flow of the R718 refrigerant from the single condenser, the R718 refrigerant flow splitter also having a first outlet conduit and a second outlet conduit where the R718 flow splitter is structured to split the flow of R718 refrigerant from the single condenser into a first portion which is provided to the first outlet conduit and a second portion which is provided to the second outlet conduit;

an air cooler heat exchanger operable for cooling compressed air with R718 refrigerant directed through the first outlet conduit;

a lubricant heat exchanger operable for cooling lubricant with the R718 refrigerant directed through the second outlet conduit; and a control system operable for controlling portions of the cooling system, the lubrication system, and the air compressor;

wherein the air cooler heat exchanger and the lubricant heat exchanger are configured to receive R718 refrigerant from the single condenser without any additional intervening condenser.

2. The apparatus of claim 1, wherein the control system includes at least one pressure sensor, temperature sensor and/or mass flow sensor.

3. The apparatus of claim 1, wherein the control system includes an electronic controller operable for receiving and transmitting control signals.

4. The apparatus of claim 1, wherein the air compressor includes more than one compression stage.

5. The apparatus of claim 1, wherein the air compressor is one of a screw, gear, piston, or centrifugal type.

6. The apparatus of claim 1, wherein R718 is pure water.

7. The apparatus of claim 1, where R718 includes contaminants at a level insufficient to prevent phase change of the refrigerant while flowing through the cooling system pathway.

* * * * *